United States Patent [19]

Hammelmann

[11] Patent Number: 5,028,004

[45] Date of Patent: Jul. 2, 1991

[54] NOZZLE HEAD

[76] Inventor: Paul Hammelmann, Zum Sundern 17, 4740 Oelde 1, Fed. Rep. of Germany

[21] Appl. No.: 390,187

[22] Filed: Aug. 4, 1989

Related U.S. Application Data

[63] Continuation-in-part of Ser. No. 335,943, Apr. 10, 1989, Pat. No. 4,923,120.

[30] Foreign Application Priority Data

Aug. 11, 1988 [DE] Fed. Rep. of Germany ..... 3827251

[51] Int. Cl.[5] ..... B05B 1/28; B05B 3/06

[52] U.S. Cl. ..... 239/120; 239/252; 134/176; 15/322

[58] Field of Search ..... 239/251, 252, 259, 261, 239/104, 120; 134/176, 179; 15/320, 321, 322, 345, 385

[56] References Cited

U.S. PATENT DOCUMENTS

| | | | |
|---|---|---|---|
| 965,315 | 7/1910 | Moorhead | 15/322 |
| 2,239,183 | 4/1941 | Willard | 15/320 |
| 2,315,844 | 4/1943 | Ferrando et al. | 239/259 |
| 3,073,727 | 1/1963 | Mullinix et al. | 15/322 |
| 3,744,721 | 7/1973 | Baumstark, Jr. | 239/261 |
| 3,751,747 | 8/1973 | Blaeldh | 15/321 |
| 4,047,666 | 9/1977 | Hart | 239/251 |
| 4,107,816 | 8/1978 | Matthews | 239/225.1 |
| 4,191,589 | 3/1980 | Halls et al. | 15/322 |
| 4,439,954 | 4/1984 | Bennett | 239/251 |
| 4,600,149 | 7/1986 | Wakatsuki | 239/264 |
| 4,690,325 | 9/1987 | Pacht | 239/263.1 |
| 4,704,826 | 11/1987 | Kirkland | 239/252 |

*Primary Examiner*—Andres Kashnikow
*Assistant Examiner*—Christopher G. Trainor
*Attorney, Agent, or Firm*—Michael J. Striker

[57] ABSTRACT

A nozzle head comprises an immovable housing provided with a pressure water connection, a nozzle support rotatable about an axis in the housing, a rotatable hollow shaft connected with the nozzle support and having a central opening, a sleeve arranged in the central opening of the hollow shaft and sealed relative to the latter, and a suction hood provided with a suction pipe and having an upper end mounted on the housing and a lower end having a seal to be supported on a surface to be cleaned.

13 Claims, 3 Drawing Sheets

NOZZLE HEAD

CROSS-REFERENCE TO RELATED APPLICATION

This application is a continuation-in-part of U.S. patent application Ser. No. 335,943 filed on Apr. 10, 1989 now U.S. Pat. No. 4,923,120.

BACKGROUND OF THE INVENTION

The present application relates to a nozzle head which has a nozzle support rotatable about an axis driveable by a return flow of the pressure water exiting the nozzles, a brake for braking the rotary movement of the nozzle support, and a stationary housing provided with a pressure connection.

Such a nozzle head is disclosed in the patent application, Ser. No. 335,943. In this drill head a stationary sleeve extends from the pressure water connection and guides the pressure water. The sleeve is arranged in a central passage of a hollow shaft rotatably supported in the housing and connected with the nozzle support. The sleeve extends in an opening of the hollow shaft which expands in diameter relative to a central passage. A labyrinth gap seal is provided between the sleeve and a limiting surface of the expanding opening, has a plurality of ring grooves arranged in the sleeve and expanding the ring gap at one end.

The thusly designed nozzle head can operate with high working pressures and used for removing rust, removing varnish and also for removing concrete to a depth of several centimeters. The nozzle head can be adjusted to such a working pressure which makes unnecessary a sand for a surface cleaning. The cleaning works with pressure water under high working pressures lead to a considerable noise generation and to moistening of the surrounding area of the nozzle head with contaminated water.

SUMMARY OF THE INVENTION

Accordingly, it is an object of the present invention to provide a nozze head which, in addition to intensive surface cleaning, for drying of the cleaned surface, withdrawal of the cleaning water enriched with the removed particles, and a noise-free operation.

In keeping with these objects and with others which will become apparent hereinafter, one feature of the present invention resides, briefly stated, in that the nozzle head operates with a pressure water at at least 1,000 bar and it is surrounded by a suction hood provided with a suction pipe formed so that it surrounds the nozzle head and is open toward a surface to be cleaned, wherein the suction hood has an upper end mounted on a stationary housing and a lower edge provided with a circularly closed seal supported on a surface to be cleaned.

The water which meets the surface to be cleaned with a high kinetic energy warms up the surface to be cleaned and therefore dries the latter. The water enriched with the particles removed from the surface to be cleaned are withdrawn through a suction pipe. The water received by the suction hood and the suction pipe is considerably sound so that the device operates with a low noise or in a noise-free manner.

In accordance with another feature of the present invention, the suction hood has a lower cylindrical part and an upper upwardly conically reducing part.

The suction pipe extends from the above mentioned conically reducing part of the suction hood.

Still a further feature of the present invention is that the seal on the lower cylindrical part of the suction hood is arranged in a height adjustable manner.

In accordance with a further feature of the present invention, the lower cylindrical part of the suction hood is surrounded by a ring-shaped supporting member for the seal which is at least one subdivided vertically and pressed on the cylindrical part by means of a clamping ring.

The clamping ring can be provided with rollers arranged to roll on a surface to be cleaned. The above mentioned seal can be formed as a brush seal.

In accordance with another feature of the present invention the diameter of the suction hood in the region of the nozzle support can amount to substantially double the outer diameter of the nozzle support. The working pressure of the pressure water can lie in the region of between 1,000 and 3,000 bar.

Furthermore, a spacer ring can be arranged with offset relative to the lower limiting surface of the nozzle head connected by a supporting web with a non-rotatable outer part of the nozzle head.

Finally, a gripping member can be arranged on the pressure water connection for turning on and turning off the water supply.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
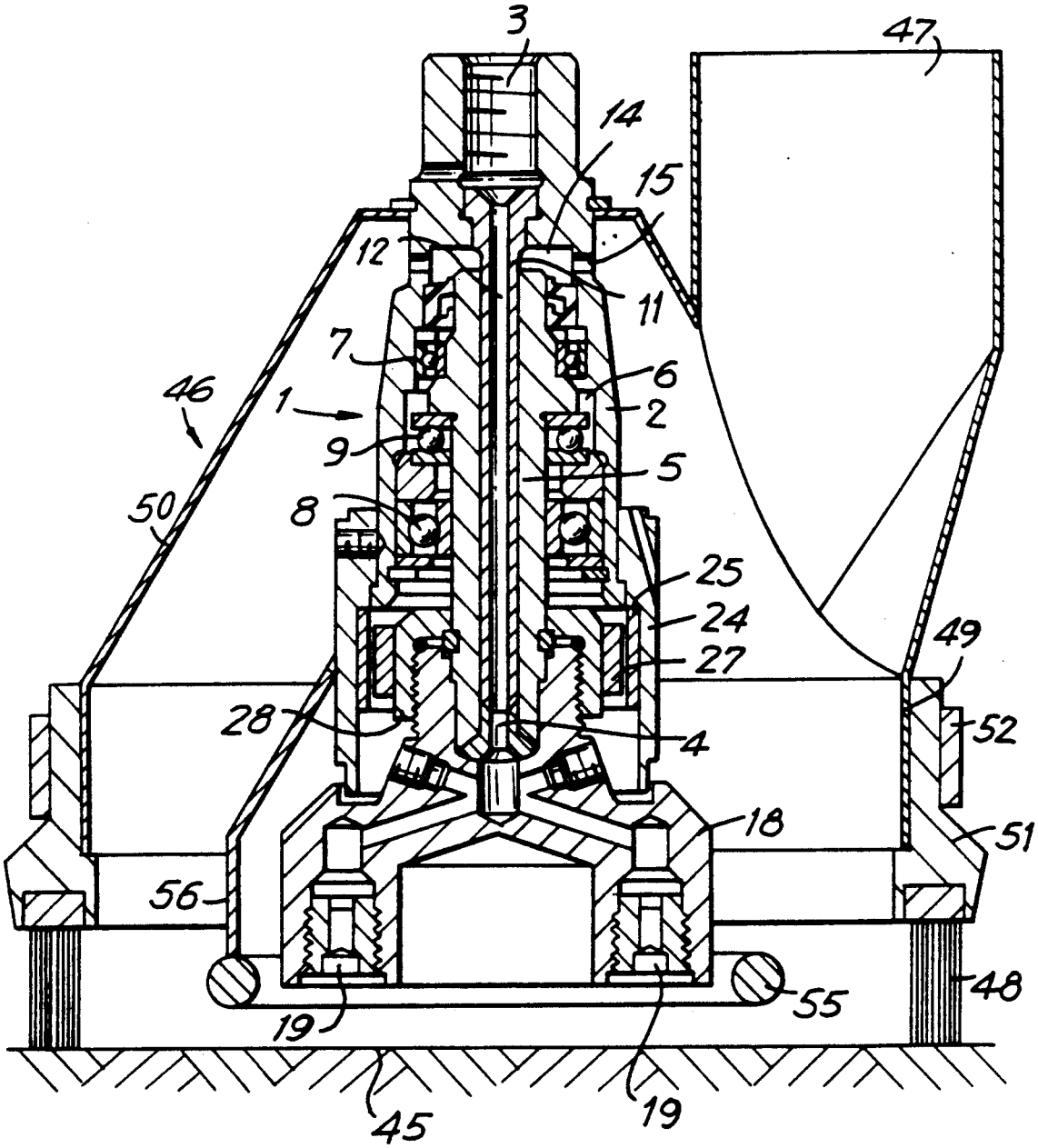
FIG. 1 is a view showing a vertical section of a nozzle head in accordance with the present invention.

A nozzle head 1 in accordance with the present invention has a stationary, cylindrical housing 2 provided with a pressure water connection 3. A hollow shaft 5 is rotatably supported in the housing and has a central passage 4. For this purpose the hollow shaft is supported in the interior of the housing 6 on pressure bearings 7 and 8 and on a shoulder bearing 9.

A sleeve 11 extends in an opening 12 of the hollow shaft 5 from the pressure water connection 3. The sleeve 11 is provided on its periphery with circular grooves 60 which are arranged at small distances from one another and have a semicircular cross-section. The grooves form part of a labyrinth gap seal between the sleeve 11 and a limiting surface of the opening 12. The partial quantity of the pressure medium which flows through the labyrinth seal is received by a chamber 14 which is provided with radially outwardly extending discharge openings 15.

The hollow shaft carries a nozzle support 18 at its end facing away of the pressure water connection 3. Spray nozzles 19 are arranged in the nozzle support 18. They are supplied with pressure water through a passage system provided in the nozzle support and supplied with pressure water from the central passage 4 of the hollow shaft 5.

A sleeve-shaped support member 24 is mounted on the housing and carries a copper ring 25. The copper ring 25 surrounds permanent magnet 27 at a certain distance from the latter. The permanent magnets 27 are mounted on a ring member 28. The permanent magnets and the copper ring form an eddy current brake with which the rotary movement of the nozzle support 18 is braked.

The working pressure of the pressure water amounts to at least 1,000 bar and lies for example in the pressure region between 1,000 and 3,000 bar.

The nozzle head 1 is surrounded by a suction hood 46 which is open to a surface 45 to be cleaned. The suction hood 46 is mounted on an upper end of the housing 2. It is provided with a suction pipe 47 for withdrawing the cleaning water enriched with particles removed from the surface to be cleaned.

The suction hood 46 is provided with a seal 48 at its side facing toward the surface to be cleaned. The seal 46 is supported on the surface 45 to be cleaned and in the shown embodiment is formed as a brush seal. The seal 48 is arranged on a lower cylindrical part 49 of the suction hood 46 in a height-adjustable manner. Above the cylindrical part 49, the suction hood 46 has an upwardly conically reducing part 50. The suction pipe 46 extends from the conically reducing part 50.

For the height adjustment of the seal 48, the lower cylindrical part 49 of the suction hood is surrounded by a ring-shaped supporting member 51. The supporting member 51 is subdivided at least once in the vertical direction. The seal 48 is anchored in the supporting member 51. The force transmission between the ring-shaped supporting member 51 and the cylindrical part 49 of the suction hood 46 is performed by a clamping ring 52. The parts of the clamping ring 52 are connected with one another by clamping screws 53.

Rollers 54 are rotatably supported on the clamping ring 52. In operation they are placed on the surface 45 to be cleaned and roll on this surface during movement of the device. The rollers determine the distance of the nozzle openings from the surface to be cleaned.

The clamping ring 52 can be vertically adjusted relative to the ring-shaped supporting member 51 on the one hand, and the ring-shaped supporting member can be adjusted relative to the part 49 of the suction hood on the other hand. Thereby the position of the seal 48 relative to the rollers 54 is adjustable.

A spacer ring 55 is located between the lower limiting surface of the nozzle support 18 and the surface 45 to be cleaned. The spacer ring 55 can be produced from metal and mounted through a supporting web 56 on the supporting member 24. The spacer ring 55 in the shown embodiment has a circular cross-section and forms a safety feature for preventing a direct contact of the nozzle openings with the surface to be cleaned.

In the shown embodiment, the inner diameter of the suction hood in the region of the nozzle support substantially corresponds to the double outer diameter of the nozzle support 18.

Figure 2:
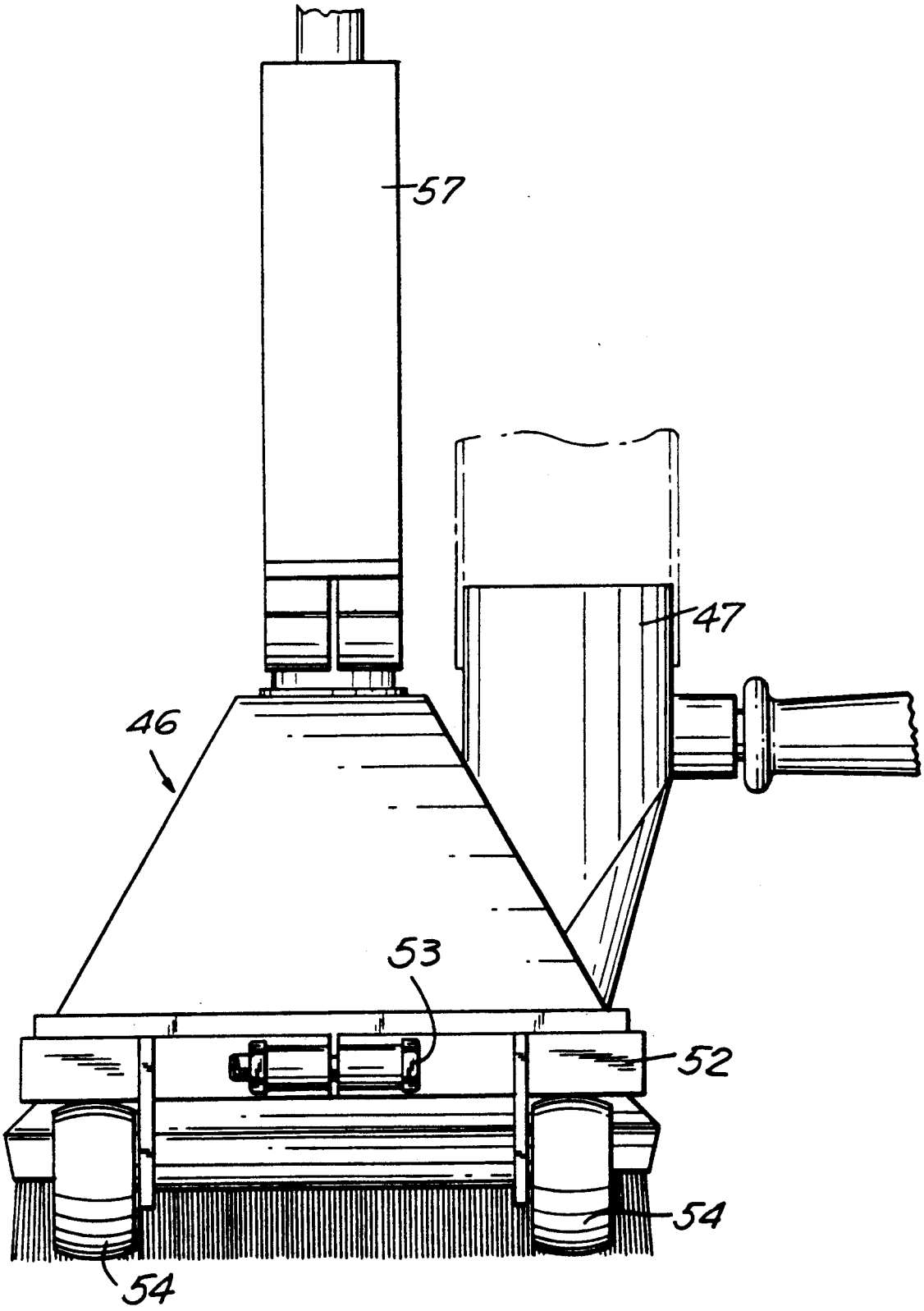
FIG. 2 is a view showing a contour of the inventive nozzle head of FIG. 1 on a reduced scale.
Figure 3:
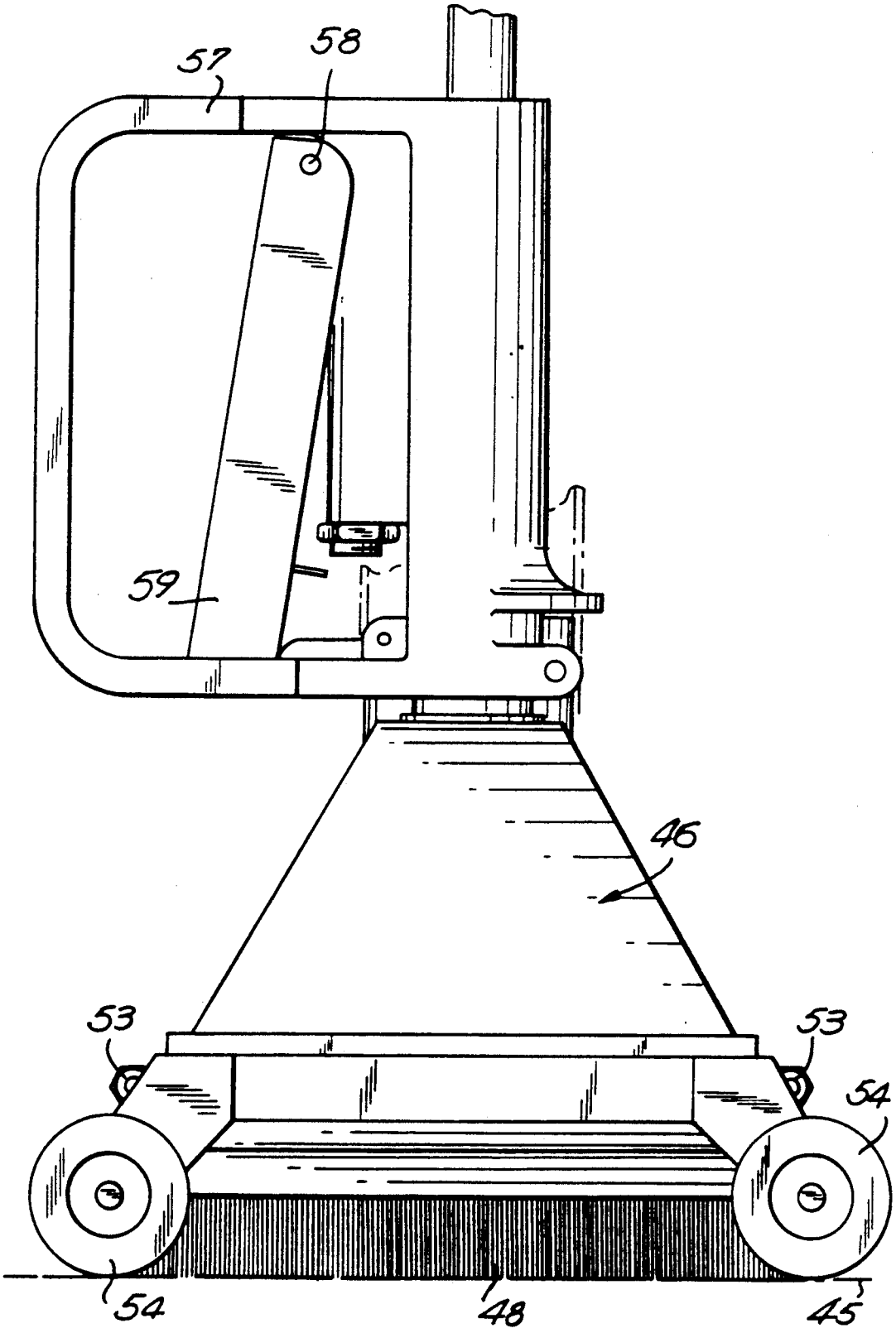
FIG. 3 is a side view of the inventive nozzle head of FIG. 2.

As can be seen from FIGS. 2 and 3, a handle 57 is arranged on the pipe of the pressure water connection 3. A gripping member 59 is supported in the handle 15 turnably about a horizontal axis 58. The water supply can be turned on or turned off by the gripping member 59.

It will be understood that each of the elements described above, or two or more together, may also find a useful application in other types of constructions differing from the types described above.

While the invention has been illustrated and described as embodied in a nozzle head, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A nozzle head, comprising an immovable housing provided with a pressure water connection; a nozzle support rotatable about an axis in said housing; at least one nozzle provided on said support and having a nozzle opening; a rotatable hollow shaft connected with said nozzle support and having a central passage; a sleeve arranged in said central passage of said hollow shaft and sealed relative to the hollow shaft; a suction hood provided with a suction pipe and having an upper end mounted on said housing and a lower end opening to a surface to be cleaned and having a seal to be supported on the surface to be cleaned; and means for preventing direct contact of said nozzle opening with the surface to be cleaned said means for preventing a spacer ring arranged to define a space between the nozzle support and the surface to be cleaned and outwardly offset relative to a lower face of said nozzle support; and a support web connecting said spacer ring with the immovable housing.

2. A nozzle head as defined in claim 1; and further comprising labyrinth gap sealing means between said sleeve and said central passage.

3. A nozzle head as defined in claim 1, wherein said suction hood has a lower cylindrical part and an upwardly conically reducing part.

4. A nozzle head as defined in claim 3, wherein said suction pipe extends from said conically reducing part of said suction hood.

5. A nozzle head as defined in claim 3, wherein said seal is arranged on said lower cylindrical part of said suction hood in a height-adjustable manner.

6. A nozzle head as defined in claim 5; and further comprising a ring-shaped supporting member for said seal, said lower cylindrical part of said suction hood being connected with said supporting member in a force-transmitting manner.

7. A nozzle head as defined in claim 6, wherein said supporting member of said seal is at least once subdivided in the vertical direction.

8. A nozzle head as defined in claim 6; and further comprising a clamping ring pressing said ring-shaped supporting member on said cylindrical part of said suction hood.

9. A nozzle head as defined in claim 8; and further comprising a plurality of rollers rotatably supported on said clamping ring for placing on the surface to be cleaned.

10. A nozzle head as defined in claim 1, wherein said nozzle support has a predetermined outer diameter, said suction hood in the region of said nozzle support having an inner diameter substantially corresponding to double the outer diameter of said nozzle support.

11. A nozzle head as defined in claim 1, wherein said pressure connection is formed so as to supply a pressure water with a working pressure in the region between 1,000 and 3,000 bar.

12. A nozzle head as defined in claim 1; and further comprising a gripping member for turning on and turning off water supply.

13. A nozzle head as defined in claim 12, wherein said gripping member is mounted on said pressure water connection.

* * * * *